United States Patent [19]

Toda

[11] 4,361,413

[45] Nov. 30, 1982

[54] WORK FEED APPARATUS IN A PRESS

[75] Inventor: Setsuo Toda, Sagamihara, Japan

[73] Assignee: Aida Engineering Ltd., Sagamihara, Japan

[21] Appl. No.: 116,290

[22] Filed: Jan. 28, 1980

[30] Foreign Application Priority Data

Jan. 22, 1979 [JP] Japan ..... 54-5001[U]

[51] Int. Cl.[3] ..... B30B 13/00

[52] U.S. Cl. ..... 414/752; 414/225; 414/744 B; 414/749; 198/488; 198/689; 100/207

[58] Field of Search ..... 414/749, 750, 752, 744 B, 414/225; 72/405, 421; 100/207; 198/486, 488, 689

[56] References Cited

U.S. PATENT DOCUMENTS

| | | | |
|---|---|---|---|
| 2,980,266 | 4/1961 | Boros | 414/749 X |
| 3,034,663 | 5/1962 | Crosby et al. | 414/749 X |
| 3,097,753 | 7/1963 | Wallace et al. | 198/486 |
| 3,199,439 | 8/1965 | Danly | 414/749 X |
| 3,703,834 | 11/1972 | Beezer | 414/749 X |
| 3,834,213 | 9/1974 | Henzler et al. | 414/225 X |
| 3,857,496 | 12/1974 | Gonzales | 414/744 B X |
| 3,937,056 | 2/1976 | Henzler et al. | 72/405 |
| 3,948,162 | 4/1976 | Numba | 72/405 X |
| 3,960,276 | 6/1976 | Gerhardt | 198/689 X |
| 4,027,767 | 6/1977 | Glock | 198/488 X |

FOREIGN PATENT DOCUMENTS

| | | | |
|---|---|---|---|
| 50-79741 | 1/1977 | Japan | 414/744 B |

*Primary Examiner*—Edward R. Kazenske
*Assistant Examiner*—Terrance L. Siemens
*Attorney, Agent, or Firm*—Holman & Stern

[57] ABSTRACT

A work feed method and apparatus for feeding workpieces to and from the die of a press comprises a feed rack having a workpiece clamping device thereon is disposed within the press gap and reciprocates horizontally between positions where it picks up pieces from a supply stage at the die and transfers them simultaneously to the die and discharge stages. The feed bar is operated by a drive unit driven by an electric motor and having a rocking arm mechanism connected to the feed bar to reciprocate the latter horizontally and a slide mechanism at each end of the feed bar to reciprocate the feed bar vertically which is operated by a camming mechanism through a ball crank device which is operated by a lift rod driven through a camming mechanism by the drive motor.

4 Claims, 9 Drawing Figures

WORK FEED APPARATUS IN A PRESS

BRIEF SUMMARY OF THE INVENTION

This invention relates to a work feed method and apparatus in a press. Hithertofore, when a work piece is supplied to and discharged from a plurality of presses arranged in a press line, as shown in FIGS. 1 and 2, in most cases, an industrial robot R provided with a work turning gripper is provided in front of each of the presses or between adjacent presses in the press line. However, when the industrial robot is employed, it is necessary that an intermediate feed device is provided between adjacent robots for transferring the work between the robots. In such a case, the front of the press is obstructed by the robot and thus, when the die on the press is replaced or removed, the robot is required to be moved from its designed position with respect to its associated press and such replacement is inconvenient.

Therefore, one object of the present invention is to provide a work feed apparatus for a press which can effectively eliminate the disadvantages inherent in the prior art robot type work feed apparatus referred to hereinabove.

Another object of the present invention is to provide a work feed apparatus which can be associated with each of a plurality of presses in a press line which are disposed in a straight line or a substantially L-shaped line without requiring any severe positioning requirement.

Another object of the present invention is to provide a work feed apparatus which can be associated with each of a plurality of presses in a press line and leaves the front of the press uncovered to thereby accelerate the die replacement and ensure an efficient pressing operation.

A still further object of the present invention is to provide a method for feeding and discharging to and from a press of a plurality of presses arranged in a press line by the employment of the work feed apparatus of the type referred to hereinabove.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION

The present invention will now be described referring to the accompanying drawings which show one preferred embodiment of work feed apparatus of the invention for illustration purpose only.

Figure 1:
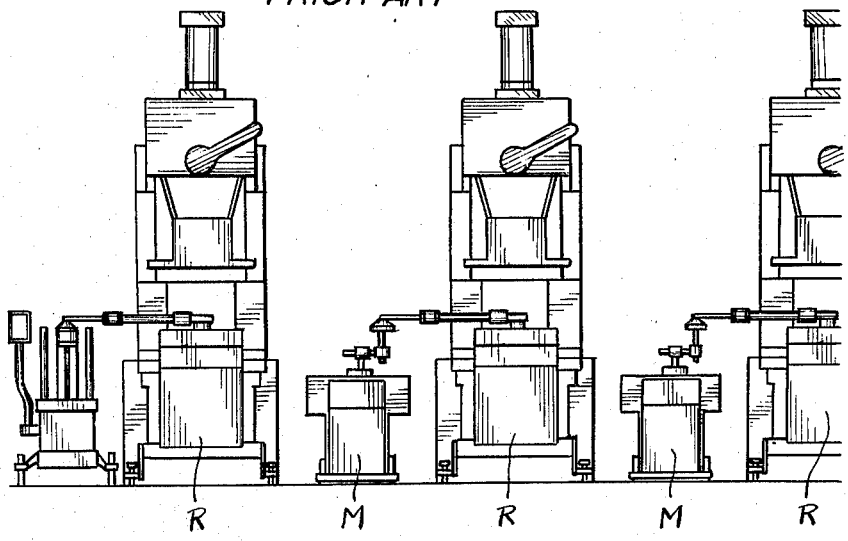
FIG. 1 PRIOR ART
FIG. 1 is a schematic front elevational view of a press line comprising a plurality of presses arranged in a straight line where a conventional industrial robot is employed for serving each press.
Figure 2:
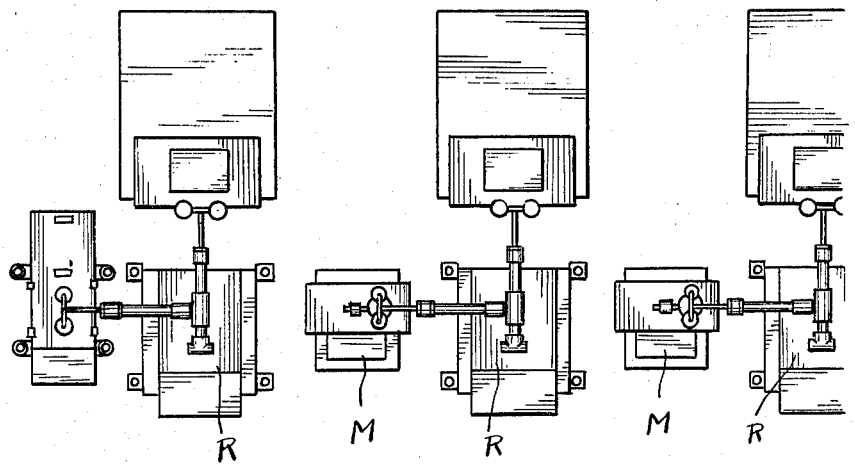
FIG. 2 PRIOR ART
FIG. 2 is a top plan view of said press line as shown in FIG. 1.
Figure 3:
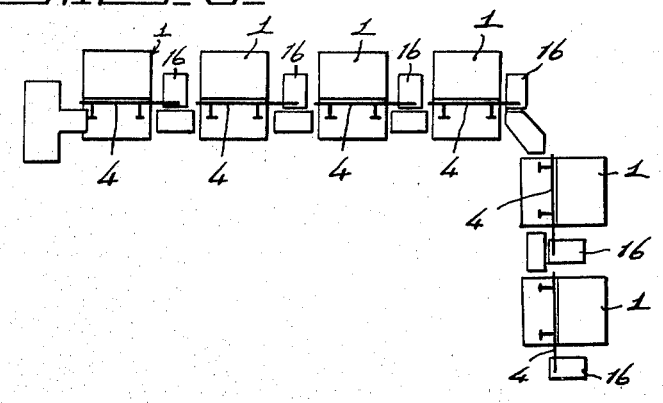
FIG. 3 is a schematic top plan view of a press line in which a plurality of presses are arranged in a substantially L-shape configuration where a conventional industrial robot is employed for serving each press.
Figure 4:
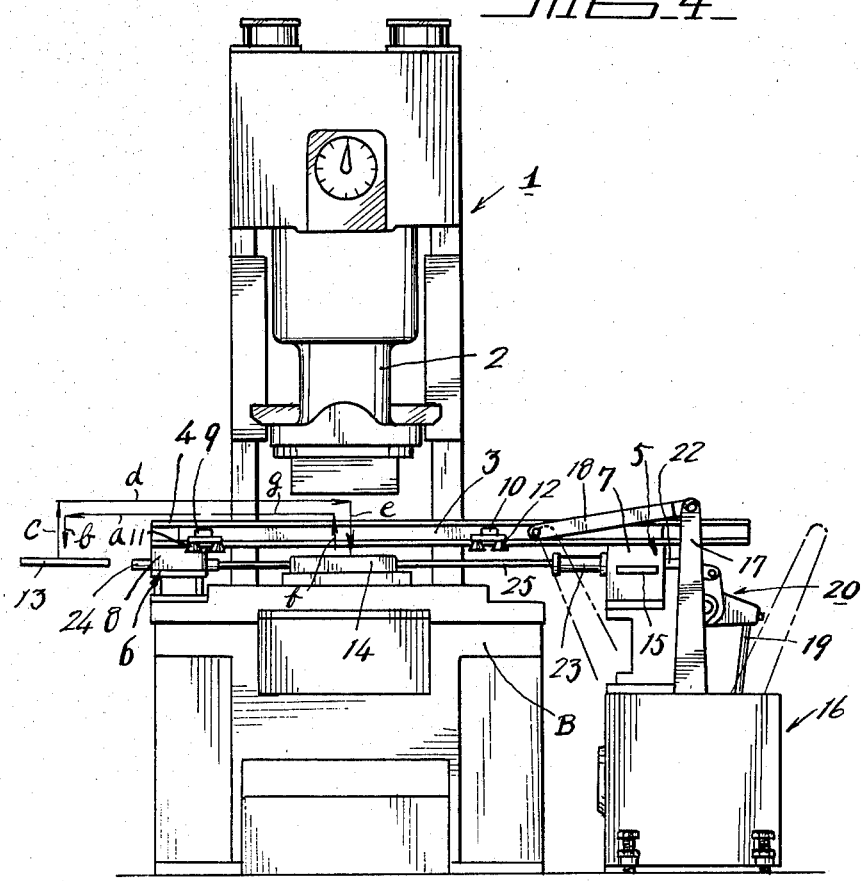
FIG. 4 is a schematic front elevational view of one preferred embodiment of work feed apparatus of this invention showing the relationship between a press and work feed apparatus and also the work feed order.
Figure 5:
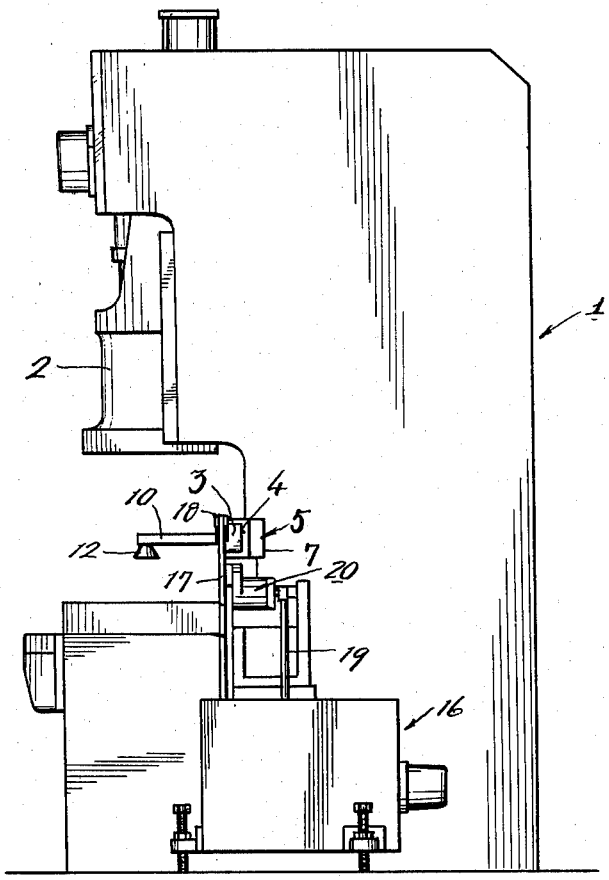
FIG. 5 is right side elevational view of said work feed apparatus of FIG. 4.

FIGS. 4 and 5 are front and side elevational views showing the work feed apparatus of the invention as being operatively associated with one selected press in the press line as shown in FIGS. 1 and 2 or FIG. 3. The press 1 has a slide 2 mounted on the front surface thereof and a transverse guide member 4 mounted on the front surface of the press below the slide 2 extending transversely of the press and having a feed bar 3 slidably received therein. The guide member 4 is mounted at the opposite ends on the lift plates 7, 8 of lift units 5, 6 disposed on the opposite sides of the press 1 whereby as the lift plates 7, 8 move upwardly and downwardly as will be described hereinafter, the guide member 4 moves upwardly and downwardly carrying the feed bar 3 therewith, accordingly.

The feed bar 3 has a pair of support pieces 9, 10 provided at and extending forwardly from the opposite ends and a first pair of vacuum clampers or cups 11, 11 and a second pair of vacuum clampers or cups 12, 12 extend downwardly from the leading end of each of the support pieces 9, 10 on the feed bar 3, respectively. The vacuum clampers 11, 11 serve as supply clampers and the vacuum clampers 12, 12 serve as discharge clampers, respectively. The supply and discharge vacuum clampers 11, 11 and 12, 12 are so positioned and operated that the clampers 11, 11 transfer a workpiece (not shown) from the center of an intermediate supply stage 13 onto a midpoint of a die 14 disposed on a lower die bed B whereas the clampers 12, 12 transfer the work from the midpoint of the die 14 onto a midpoint of an intermediate discharge stage 15, respectively.

The feed bar 3 is operatively connected through a connector member 18 to a rocking arm 17 extending upwardly from a drive unit 16 so that as the rocking arm 17 rocks, the feed bar 3 is slidably moved in a horizontal direction along the guide member 4 and the vacuum clampers 11, 11 and 12, 12 are also moved together with the feed bar. The lift unit 5 is operatively connected through a slidable rod 22 and a connector rod 21 connected to the other end of the slidable rod 22 to a rocking member 20 which is in turn connected to a lift rod 19 extending from the above-mentioned drive unit 16 and the lift unit 5 is also connected through the slidable rod 22, a cylinder 23 connected to the other end of the slidable rod 22 and a connector rod 25 to a slidable rod 24 associated with the other lift unit 6 so that as the slidable rods 22, 24 slidably move in one or the other direction, the lift plates 7, 8 associated with the lift units 5, 6, respectively, are moved upwardly or downwardly.

That is, when the drive unit 16 is operated, the feed bar 3 slidably moves in one and the other directions and the lift units 7, 8 move upwardly and downwardly to cause the vacuum clampers to handle the workpiece as mentioned hereinabove in connection with FIG. 4.

When the press reaches the top dead center in its operation cycle, a signal is generated in an electric control circuit (not shown) associated with the work feed apparatus whereupon the feed bar 3 slidably received in the guide member 4 slidably moves leftwards in the arrow a direction as shown in FIG. 4. As the feed bar 3 slidably moves in this direction, the feed bar 3 carries the supply vacuum clampers 11, 11 and discharge vacuum clampers 12, 12 therewith because the clampers are secured integrally to the feed bar. As the feed bar 3 slidably moves in this direction, when the supply vacuum clampers 11, 11 and discharge vacuum clampers 12, 12 reach their predetermined positions above the intermediate supply stage 13 and die 14, respectively whereupon, the feed bar 3 is lowered in the arrow b direction as shown in FIG. 4 and the vacuum clampers 11, 11 and 12, 12 follow the downward movement of the feed bar 3 to allow the vacuum clampers 11, 11 and 12, 12 to clamp the workpiece disposed on the intermediate supply stage 13 and die 14, respectively.

After the workpiece has been clamped by the vacuum clampers 11, 11 and 12, 12, the feed bar 3 and vacuum clampers 11, 11 and 12, 12 are raised by the lift units 5, 6 in the arrow c direction as shown in FIG. 4 and the feed bar 3 and vacuum clampers 11, 11 and 12, 12 then move rightwards in the arrow d direction until the vacuum clampers 11, 11 and 12, 12 are positioned above the die 4 and the intermediate discharge stage 15, respectively. Thereafter, the lift units 5, 6 lower the feed bar and vacuum clampers assembly 3, 11, 11 and 12, 12 in the arrow e direction as shown in FIG. 4 and allow the vacuum clampers to unclamp the workpiece onto the die 14 and intermediate discharge stage 15, respectively. After the unclamping operation, the lift units 5, 6 raise the feed bar 3 in the arrow f direction as shown in FIG. 4 and the feed bar 3 is slidably moved leftwards to the initial position whereupon the movement of the feed bar 3 is terminated. When the feed bars 3 reaches the initial position, a signal is generated in the electric control circuit and the press is driven in response to the signal to process the work positioned on the die 14. After the processing operation, the press returns to the top dead center and stops in this position. Thereafter, a feed bar drive signal is generated in the electric control circuit. By repeating the above-mentioned cycle, the work supply, discharge and processing operations are repeated.

Figure 6:
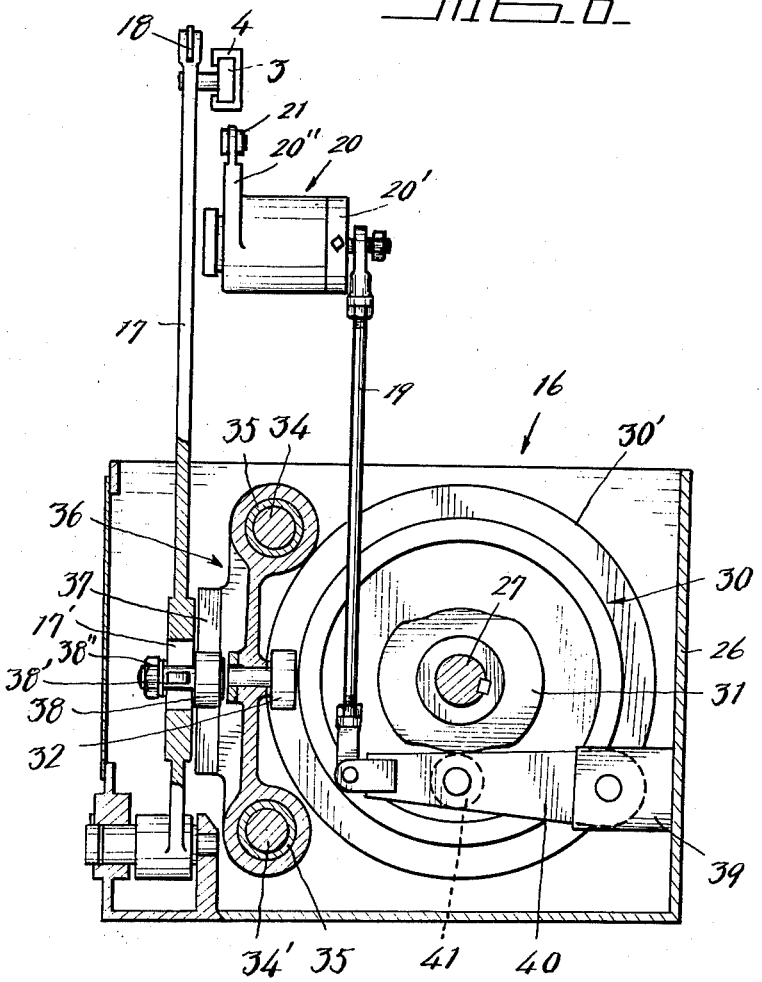
FIG. 6 is a cross-sectional view taken along the line VI—VI of FIG. 7.
Figure 7:
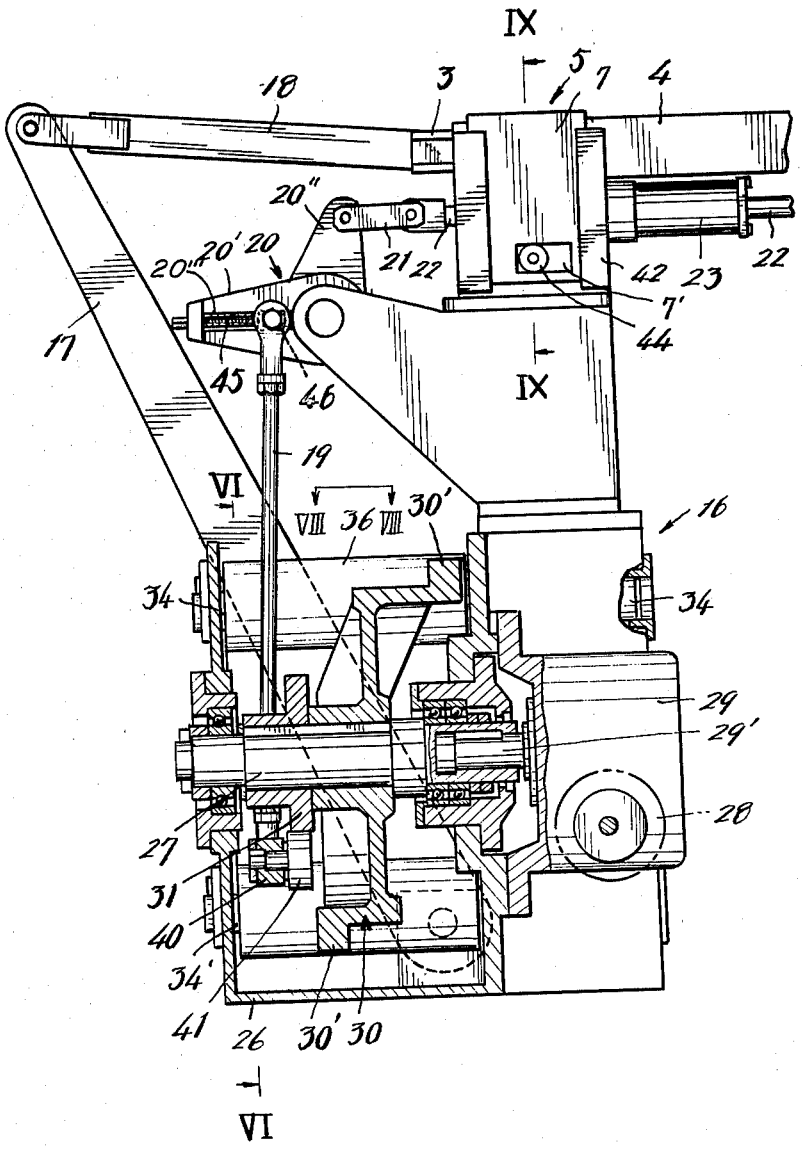
FIG. 7 is a cross-sectional enlarged view of drive unit of the work feed apparatus of FIGS. 4 and 5.
Figure 8:
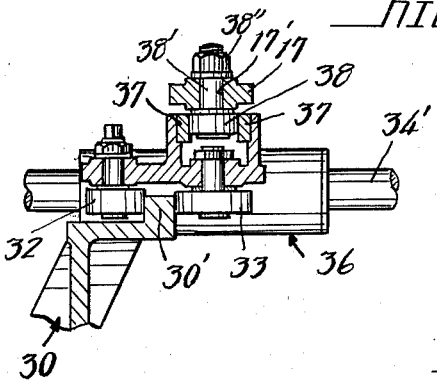
FIG. 8 is a cross-sectional view taken substantially along the line VIII—VIII of FIG. 7.

Referring now to FIGS. 6 to 8 inclusive in which the internal mechanism of the above-mentioned drive unit 16 of the work feed apparatus of the invention is in detail shown, the drive unit 16 generally comprises a casing 26 in which a shaft 27 is suitably journalled. The shaft 27 is operatively connected to the output shaft 29' of a reduction gear 29 which is in turn operatively connected to an electric motor 28 having a brake (not shown) so that when the motor 28 is energized from a power source (not shown) to rotate, the rotation of the motor is transmitted to the shaft 27 at a reduced speed through the reduction gear 29. The shaft 27 has a drum cam 30 and a cam plate 31 coaxially mounted thereon and rotates and stops as the motor 28 rotates and stops.

The drum cam 30 has an annular radially and outwardly extending guide member 30' integrally formed about the cam at the inner end thereof and a pair of roller followers 32, 33 are in rotatable contact with the inner and outer surfaces of the annular guide member 30', respectively. The roller followers 32, 33 are mounted on a slider 36 which is in turn supported on a pair of upper and lower guide shafts 34, 34' extending parallel to the above-mentioned shaft 27 by means of a pair of slide bearings 35, 35. The slider 36 is further provided with a pair of vertically spaced and opposing guide members 37, 37 between which a roller follower 38 is disposed and the follower is supported at one or the inner end of the shaft of the above-mentioned rocking arm 17 the lower end of which is journalled in the casing 26. Thus, as the slider 36 moves horizontally in one and the other directions, the movement of the slider is transmitted to the rocking arm 17 through the roller followers 38 to impart rocking movement to the arm in one and the other directions. The other or upper end of the rocking arm 17 extends upwardly through a suitable opening in the casing 26 and is connected to the feed bar 3 slidably received in the above-mentioned guide member 4 through a connector member 18 to impart horizontal movement to the feed bar 3 in one and the other directions. The rocking movement of the rocking arm 17 is so designed that when the annular guide member 30' on the drum cam 30 is disposed within the angular range of 0°–5° with respect to the horizontal, the rocking arm 17 maintains its substantially vertical position to hold the feed bar 3 in an intermediate position between the extreme ends of the predetermined horizontal movement distance of the bar, when the guide member 30' is disposed within the angular range of 65°–125° with respect to the horizontal, the rocking bar 17 and feed bar 3 are positioned at the extreme left-hand ends of their movement distance as shown in FIG. 4 (the vertical movement range for picking up the piece), and when the guide member 30' is disposed within the angular range of 240°–300° with respect to the horizontal, the rocking bar 17 and feed bar 3 are positioned at the extreme right-hand ends of the their movement distance as shown in FIG. 4 (the vertical movement range for discharging the piece). More particularly, during the time the guide member 30' is moving within the angular distance of 5°–65°, the rocking arm 17 and feed bar 3 move from the intermediate position to the left-hand ends of their movement distance during the time the guide member 30 is moving within the angular distance of 125°–240°, the rocking arm and feed bar move from the left-hand ends to the right-hand ends of their movement distance and during the time the guide member is moving within the angular distance of 300°–360°, the rocking arm and feed bar move from the right-hand ends to the left hand-ends of their movement distance, respectively. In this way, the rocking and horizontal movements of the rocking arm and feed bar can be positively and smoothly effected.

The rocking arm 17 is formed with a vertically elongated slot 17' in which a sliding face formed adjacent and inwardly of the outer end of the shaft 38' of the follower roller 38 is slidably received and by slidably moving the shaft 38' in one or the other direction with respect to the rocking arm 17, the position of the shaft 38' and accordingly, the follower roller 38 on the shaft can be adjusted to thereby vary the horizontal stroke distance of the feed bar 3. The shaft 38' is positively held in this adjusted position by tightening a suitable fastener means 38'' against the extreme right-hand end of the shaft 38'.

The cam plate 31 mounted on the above-mentioned shaft 27 coaxial with the drum cam 30 is engaged by a roller follower 41 which is in turn journalled in a rocking arm 40 at an intermediate portion between the opposite ends of the associated arm 40. The rocking arm 40 is journalled at the other or base end in a bearing bracket 39 extending integrally and inwardly from the casing 26. A lift rod 19 is pivotally connected at its lower end to the inner end of the rocking arm 40 and the lift rod is adjustably journalled at the upper end on an arm 20' extending from the rocking member 20. Thus, as the rocking arm 40 is imparted rocking movement thereto by the cam plate 31, the rocking movement of the rocking arm 40 is transmitted to the rocking member 20 through the lift rod 19.

The rocking member 20 further has a second arm 20'' extending at right angles to the first-mentioned arm 20' adjacent the other or outer end of the rocking member and the leading or free end of the second arm 20'' is connected or link through the connector member 21 to the slidable rod 22 slidably received in the casing 42 of the lift unit 5 so that as the rocking member 20 rocks back and forth about its rotational axis, the slidable rod 22 slidably and horizontally moves to the left and right as viewed in FIGS. 4 and 7.

Figure 9:
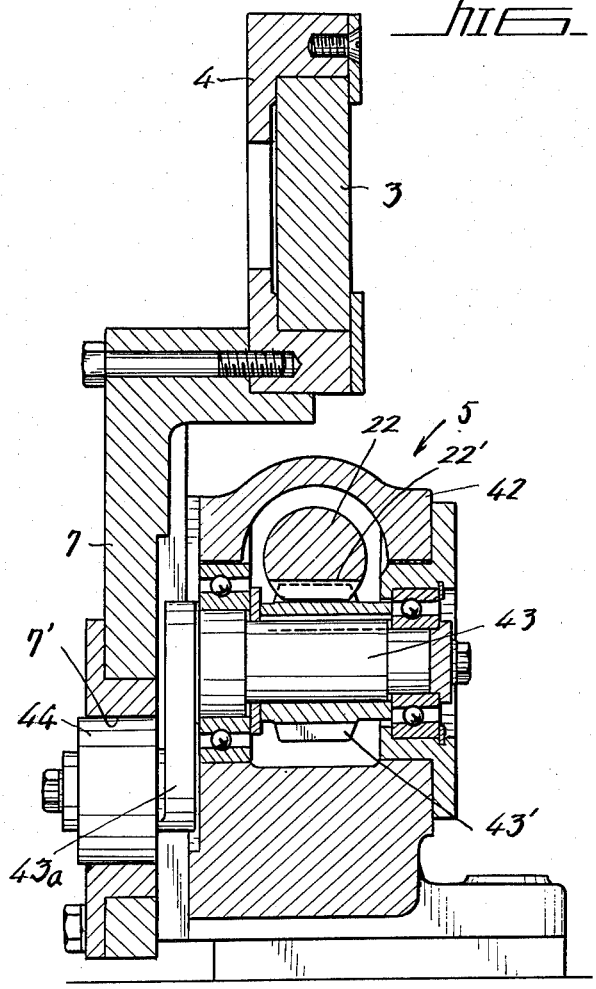
FIG. 9 is a cross-sectional view taken along line IX—IX of FIG. 7 of one of the lift units of said work feed apparatus.

FIG. 9 is a fragmentary cross-sectional view taken substantially along the line IX—IX of FIG. 7 and shows the internal construction of each of the lift units 5, 6. For simplification purpose, only one of the lift units will be described hereinbelow with the understanding that the explanation of one lift unit can be equally applied to the other lift unit. The lift unit 5 or 6 generally comprises the casing 42 fixedly mounted on the framework of the work feed apparatus and the above-mentioned slidable rod 22 is slidably received in the casing 42. The undersurface of the slidable rod 22 is formed with a rack 22' which meshes with a pinion 43' mounted on a pinion shaft 43 journalled in the casing 42 so that the linear movement of the slidable rod 22 is transmitted to the pinion 43' to rotate the pinion. The pinion shaft 43 has an eccentric disc **43*a* secured at one end thereto outside of the casing 42 in a position eccentric with respect to the axis of the pinion shaft 43. The eccentric disc 43*a* has a roller 44 mounted thereon, also eccentric with respect to the axis of shaft 43, which is received in a through slot 7' formed in the vertical lift plate 7 so that as the eccentric disc 43*a* rotates, the roller 44 rolls along its circular periphery in the slot 7' to move the lift plate 7 by camming action upwardly and downwardly in guideways on the casing 42**.

The lift unit 6 has substantially the same construction as that of the lift unit 5 and has the slidable rod 24 slidably received in the lift unit 6. The slidable rod 24 is operatively connected to the cylinder 23 associated with the lift unit 5 through the connector rod 25 whereby the slidable rods 22, 24 cooperate with each other to simultaneously move the lift plates 7, 8 upwardly and downwardly.

The amount of vertical movement of the lift plates can be adjusted by moving an adjuster 46 to which the lift rod 19 is pivotally connected and which is in threaded engagement with a threaded adjusting rod 45 received in a groove 20''' formed in the arm 20' extending from the rocking member 20. The movement of the adjusting member 46 varies the engaging point between the lift rod 19 and arm 20' radially with respect to the rotational axis of rocking member 20.

According to the present invention, with the above-mentioned construction and arrangement of the parts of the work feed apparatus, when the drive unit 16 is operated, the feed bar 3 having the vacuum clampers 11, 12 and slidably received in the horizontal guide member 4 mounted at its opposite ends on the lift plates of the lift units disposed on the opposite sides of the press 1 is slidably moved, lifted and lowered in the order to perform the work supply and discharge operations. The work feed apparatus can be employed in connection with a single work processing cycle by the press. Furthermore, the apparatus is disposed in a straight line and the replacement of the die can be easily performed. When the work feed apparatus of the invention is employed in connection with a press line which performs the processing operation in series, the number of the presses in the press line can be freely and optionally selected in conformity with the number of pressing steps involved. And since severe preciseness in the installation pitch for the presses is not required, the installation pitch can be freely selected. Thus, even when the work feed apparatus is employed in connection with the existing presses, the work feed apparatus can be operatively connected to each of the presses without being moved for automation operation.

For pressing operations such as drawing and boring, the vertical movement amount of the handling device in the work feed apparatus can be varied within a wide range depending upon the nature of the pressing operation whereby it makes it possible to perform any complicate processing operation.

While only one embodiment of the invention has been and shown in detail, it will be understood that the same is for illustration purpose only and is not to be taken as a definition of the invention, reference being had for this purpose to the appended claims.

What is claimed is:

1. A work feed apparatus for a press comprising a workpiece feedbar assembly including a feedbar disposed in the press gap rearwardly of a die unit adapted to be disposed at the side of the press, said drive unit including a rocking means operatively connected to said feedbar to move said feed bar horizontally in the direction transverse to the press, an operation drum cam mounted on a drive shaft and operatively connected to said rocking means to move it through a predetermined oscillating motion, a cam plate mounted on said drive shaft, a lift unit assembly, a lift rod operatively engaging said cam plate to be actuated by said cam plate and operatively connected to said lift unit assembly to impart upward and downward movement thereto, said lift unit assembly being operatively connected to said feed bar assembly to impart upward and downward movement thereto.

2. The work feed apparatus as set forth in claim 1, wherein said feed bar assembly comprises a transverse guide member having said feedbar slidably mounted thereon, at least one workpiece vacuum clamper arm provided on said feed bar extending toward the front of said press, and a workpiece vacuum clamping means mounted on said clamper arm.

3. The work feed apparatus as set forth in claim 1, wherein said rocking means and lift rod are adjustable.

4. The work feed apparatus as claimed in claim 2, wherein said guide member of said feed bar assembly is substantially U-shaped in cross-section, said feed bar is substantially rectangular in cross-section and is slidably disposed between the legs of said U-shaped guide member, and said lift-unit assembly comprises a vertically reciprocating slide member, mounted on said drive unit and attached to said guide member adjacent the ends thereof and reciprocated by a rotating eccentric disc operatively engaging said slide member.

* * * * *